US011440219B2

(12) United States Patent
Glunz

(10) Patent No.: US 11,440,219 B2
(45) Date of Patent: Sep. 13, 2022

(54) CHARGE HOPPER WITH LINER FOR CONCRETE MIXER

(71) Applicant: Oshkosh Corporation, Oshkosh, WI (US)

(72) Inventor: Clint Glunz, Rochester, MN (US)

(73) Assignee: Oshkosh Corporation, Oshkosh, WI (US)

( * ) Notice: Subject to any disclaimer, the term of this patent is extended or adjusted under 35 U.S.C. 154(b) by 0 days.

(21) Appl. No.: 17/062,325

(22) Filed: Oct. 2, 2020

(65) Prior Publication Data

US 2021/0107179 A1 Apr. 15, 2021

Related U.S. Application Data

(60) Provisional application No. 62/914,280, filed on Oct. 11, 2019.

(51) Int. Cl.
*B28C 5/42* (2006.01)

(52) U.S. Cl.
CPC ..... *B28C 5/4237* (2013.01); *B28C 5/4272* (2013.01)

(58) Field of Classification Search
CPC .... B28C 5/4237; B28C 5/4272; B28C 5/0818
USPC ..... 366/41, 53–68
See application file for complete search history.

(56) References Cited

U.S. PATENT DOCUMENTS 2,904,318 A * 9/1959 Broberg ..... B28C 5/4262 366/41
4,054,194 A * 10/1977 Davis ..... B28C 5/4248 193/10
4,154,534 A * 5/1979 Lawrence ..... B28C 5/4234 366/42
4,428,677 A * 1/1984 Schreiter, Jr. ..... B60P 3/16 366/41
4,529,660 A * 7/1985 Heim ..... B32B 27/18 428/423.1
4,645,055 A * 2/1987 Griese ..... B65G 11/166 138/110
4,889,219 A * 12/1989 Key ..... B65D 88/64 193/25 R
5,184,706 A * 2/1993 Christenson ..... B28C 5/4251 193/10
5,244,069 A * 9/1993 Cosgrove ..... B28C 5/0818 193/25 A
6,041,906 A * 3/2000 Howard ..... B65G 11/166 193/2 R
6,250,450 B1 * 6/2001 Howard ..... B65G 11/166 193/2 R
6,267,494 B1 * 7/2001 Burch ..... B28C 5/4203 116/200
6,367,606 B1 * 4/2002 Skalla ..... B28C 5/0818 193/2 R (Continued)

*Primary Examiner* — Charles Cooley

(74) *Attorney, Agent, or Firm* — Foley & Lardner LLP

(57) ABSTRACT

A mixing drum assembly includes a frame, a mixing drum rotatably coupled to the frame, and a charge hopper coupled to the frame and positioned to direct material into the mixing drum. The charge hopper includes a hopper frame and a liner extending along an inner surface of the hopper frame and at least partially defining a passage extending between an inlet and an outlet. The hopper frame includes a first material and the liner includes a second material different from the first material. The liner is removably coupled to the hopper frame.

17 Claims, 10 Drawing Sheets

(56) References Cited

U.S. PATENT DOCUMENTS

| | | | | |
|---|---|---|---|---|
| 7,232,023 | B2 * | 6/2007 | Ellis | B65G 11/166 193/2 R |
| 7,931,397 | B2 | 4/2011 | Lindblom et al. | |
| 7,938,244 | B2 * | 5/2011 | Neville | B65G 11/166 193/25 R |
| 8,287,173 | B2 | 10/2012 | Khouri | |
| 8,535,764 | B2 * | 9/2013 | Branagan | E04G 21/04 427/376.2 |
| 8,613,543 | B2 | 12/2013 | Lindblom et al. | |
| 8,646,965 | B2 | 2/2014 | Datema et al. | |
| 9,694,671 | B2 | 7/2017 | Wildgrube et al. | |
| 9,925,690 | B2 * | 3/2018 | Morrissette | B28C 5/0818 |
| 10,239,403 | B2 | 3/2019 | Broker et al. | |
| 10,414,067 | B2 | 9/2019 | Datema et al. | |
| 10,792,613 | B1 | 10/2020 | Drake et al. | |
| 10,843,379 | B2 | 11/2020 | Rocholl et al. | |
| 2011/0058446 | A1 * | 3/2011 | Khouri | B01F 29/63 366/62 |
| 2014/0269145 | A1 * | 9/2014 | Fasana | B28C 5/4237 366/41 |
| 2017/0266843 | A1 * | 9/2017 | Morrissette | B28C 5/4248 |
| 2017/0297425 | A1 | 10/2017 | Wildgrube et al. | |
| 2017/0361492 | A1 | 12/2017 | Datema et al. | |
| 2018/0250847 | A1 | 9/2018 | Wurtz et al. | |
| 2019/0091890 | A1 * | 3/2019 | Rocholl | B28C 5/1862 |
| 2019/0217698 | A1 | 7/2019 | Broker et al. | |
| 2019/0344475 | A1 | 11/2019 | Datema et al. | |
| 2020/0078986 | A1 | 3/2020 | Clifton et al. | |
| 2020/0094671 | A1 | 3/2020 | Wildgrube et al. | |
| 2020/0289985 | A1 | 9/2020 | Drake et al. | |
| 2021/0107179 | A1 * | 4/2021 | Glunz | B28C 5/0818 |

* cited by examiner

CHARGE HOPPER WITH LINER FOR CONCRETE MIXER

CROSS-REFERENCE TO RELATED PATENT APPLICATION

This application claims the benefit of U.S. Provisional Patent Application No. 62/914,280, filed Oct. 11, 2019, which is incorporated herein by reference in its entirety.

BACKGROUND

The present disclosure relates generally to concrete mixers. More specifically, the present disclosure relates to a hopper for a concrete mixer.

SUMMARY

At least one embodiment relates to a mixing drum assembly including a frame, a mixing drum rotatably coupled to the frame, and a charge hopper coupled to the frame and positioned to direct material into the mixing drum. The charge hopper includes a hopper frame and a liner extending along an inner surface of the hopper frame and at least partially defining a passage extending between an inlet and an outlet. The hopper frame includes a first material and the liner includes a second material different from the first material. The liner is removably coupled to the hopper frame.

Another embodiment relates to a charge hopper for a concrete mixer. The charge hopper includes a hopper frame configured to be coupled to a frame of the concrete mixer, a liner extending along an inner surface of the hopper frame and defining a passage extending between an inlet and an outlet, a top guard positioned adjacent the inlet and extending along an inner surface of the liner, and fasteners extending through the hopper frame and the liner to couple the liner to the hopper frame.

Another embodiment relates to a method of maintaining a charge hopper of a concrete mixer. The method includes providing the charge hopper, the charge hopper including a hopper frame and a first liner coupled to the hopper frame. The first liner at least partially defines a passage through the charge hopper. The method further includes removing the first liner from the hopper frame by removing a first fastener that couples the first liner to the hopper frame. The method further includes coupling a second liner to the hopper frame using a second fastener, the second liner at least partially defining the passage through the charge hopper.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Concrete Mixing Truck

Figure 1:
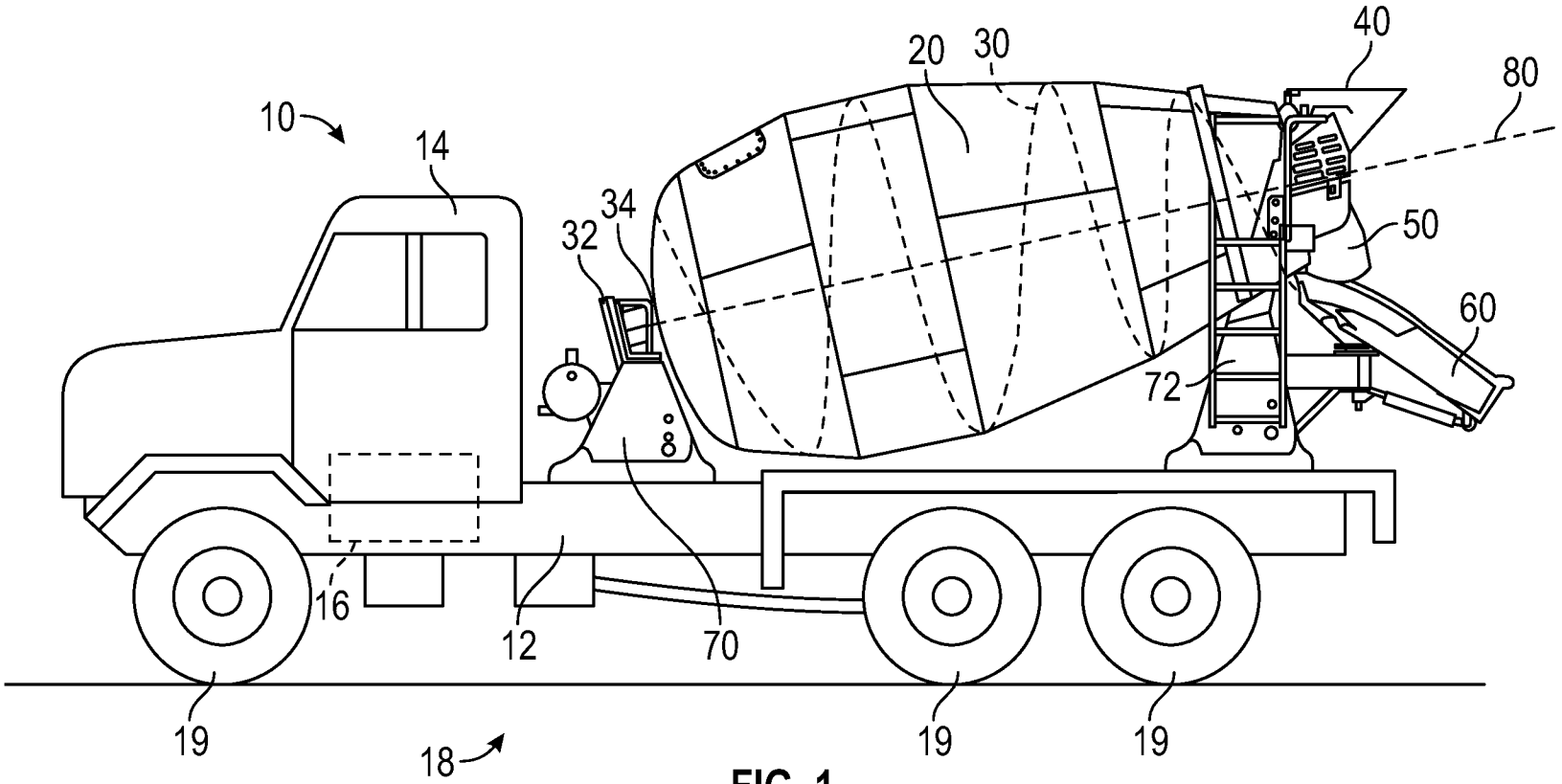
FIG. 1 is a schematic diagram of a concrete mixing truck, according to an exemplary embodiment.
Figure 2:
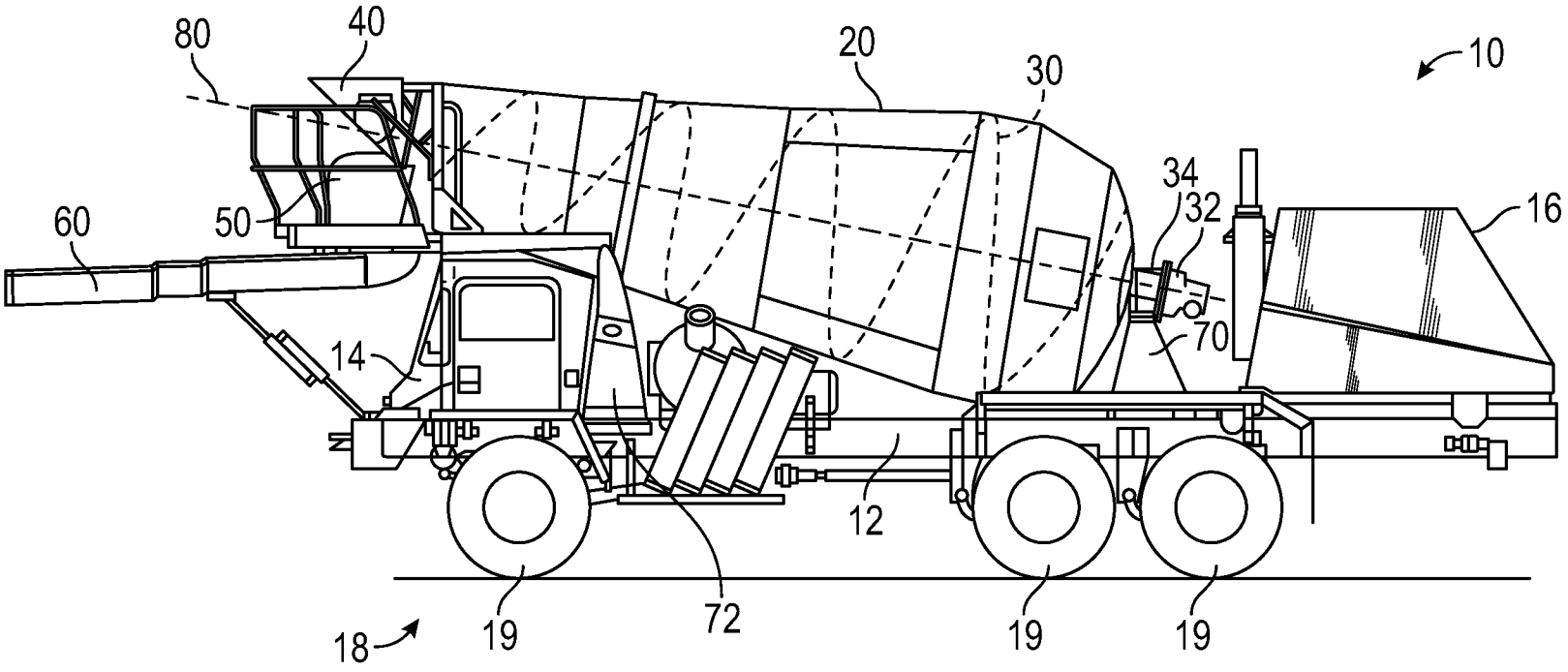
FIG. 2 is a schematic diagram of concrete mixing truck, according to another exemplary embodiment.

According to the exemplary embodiments shown in FIGS. 1 and 2, a vehicle, shown as a concrete mixing truck 10, includes a drum assembly, shown as a mixing drum 20. As shown in FIG. 1, the concrete mixing truck 10 is configured as a rear-discharge concrete mixing truck. In other embodiments, such as the embodiment shown in FIG. 2, the concrete mixing truck 10 is configured as a front-discharge concrete mixing truck. As shown in FIG. 1, the concrete mixing truck 10 includes a chassis, shown as frame 12, and a cabin, shown as cab 14, coupled to the frame 12 (e.g., at a front end thereof, etc.). The mixing drum 20 is coupled to the frame 12 and disposed behind the cab 14 (e.g., at a rear end thereof, etc.), according to the exemplary embodiment shown in FIG. 1. In other embodiments, such as the embodiment shown in FIG. 2, at least a portion of the mixing drum 20 extends beyond the front of the cab 14. The cab 14 may include various components to facilitate operation of the concrete mixing truck 10 by an operator (e.g., a seat, a steering wheel, hydraulic controls, a control panel, a control device, a user interface, switches, buttons, dials, etc.).

The concrete mixing truck 10 also includes a prime mover or primary driver, shown as engine 16. For example, the engine 16 may be coupled to the frame 12 at a position beneath the cab 14. The engine 16 may be configured to utilize one or more of a variety of fuels (e.g., gasoline, diesel, bio-diesel, ethanol, natural gas, etc.), according to various exemplary embodiments. According to an alternative embodiment, the engine 16 additionally or alternatively includes one or more electric motors coupled to the frame 12 (e.g., a hybrid vehicle, an electric vehicle, etc.). The electric motors may consume electrical power from an on-board storage device (e.g., batteries, ultra-capacitors, etc.), from an on-board generator (e.g., an internal combustion engine, etc.), and/or from an external power source (e.g., overhead power lines, etc.) and provide power to systems of the concrete mixing truck 10.

The concrete mixing truck 10 may also include a transmission that is coupled to the engine 16. The engine 16 produces mechanical power (e.g., due to a combustion reaction, etc.) that may flow into the transmission. The concrete mixing truck 10 may include a vehicle drive system 18 that is coupled to the engine 16 (e.g., through the transmission). The vehicle drive system 18 may include drive shafts, differentials, and other components coupling the transmission with a ground surface to move the concrete mixing truck 10. The concrete mixing truck 10 may also include a plurality of tractive elements, shown as wheels 19, that engage a ground surface to move the concrete mixing truck 10. In one embodiment, at least a portion of the mechanical power produced by the engine 16 flows through the transmission and into the vehicle drive system 18 to power at least some of the wheels 19 (e.g., front wheels, rear wheels, etc.). In one embodiment, energy (e.g., mechanical energy, etc.) flows along a power path defined from the engine 16, through the transmission, and to the vehicle drive system 18.

As shown in FIGS. 1 and 2, the mixing drum 20 includes a mixing element (e.g., fins, etc.), shown as a mixing element 30, positioned within the interior (e.g., an internal volume) of the mixing drum 20. The mixing element 30 may be configured to (i) mix the contents of mixture within the mixing drum 20 when the mixing drum 20 is rotated (e.g., by a drum drive system) in a first direction (e.g., counterclockwise, clockwise, etc.) and (ii) drive the mixture within the mixing drum 20 out of the mixing drum 20 (e.g., through a chute, etc.) when the mixing drum 20 is rotated (e.g., by a drum drive system including a drum driver 32) in an opposing second direction (e.g., clockwise, counterclockwise, etc.). The concrete mixing truck 10 also includes an inlet (e.g., hopper, etc.), shown as charge hopper 40, a connecting structure, shown as discharge hopper 50, and an outlet, shown as chute 60. The charge hopper 40 is fluidly coupled with the mixing drum 20, which is fluidly coupled with the discharge hopper 50, which is fluidly coupled with the chute 60. In this way, wet concrete may flow into the mixing drum 20 from the charge hopper 40 and may flow out of the mixing drum 20 into the discharge hopper 50 and then into the chute 60 to be dispensed. According to an exemplary embodiment, the mixing drum 20 is configured to receive a mixture, such as a concrete mixture (e.g., cementitious material, aggregate, sand, rocks, etc.), through the charge hopper 40.

The drum driver 32 is configured to provide mechanical energy (e.g., in a form of an output torque) to rotate the mixing drum 20. The drum driver 32 may be a hydraulic motor, an electric motor, a power take off shaft coupled to the engine 16, or another type of driver. The drum driver 32 is coupled to the mixing drum 20 by a shaft, shown as drive shaft 34. The drive shaft 34 is configured to transfer the output torque to the mixing drum 20.

Figure 3:
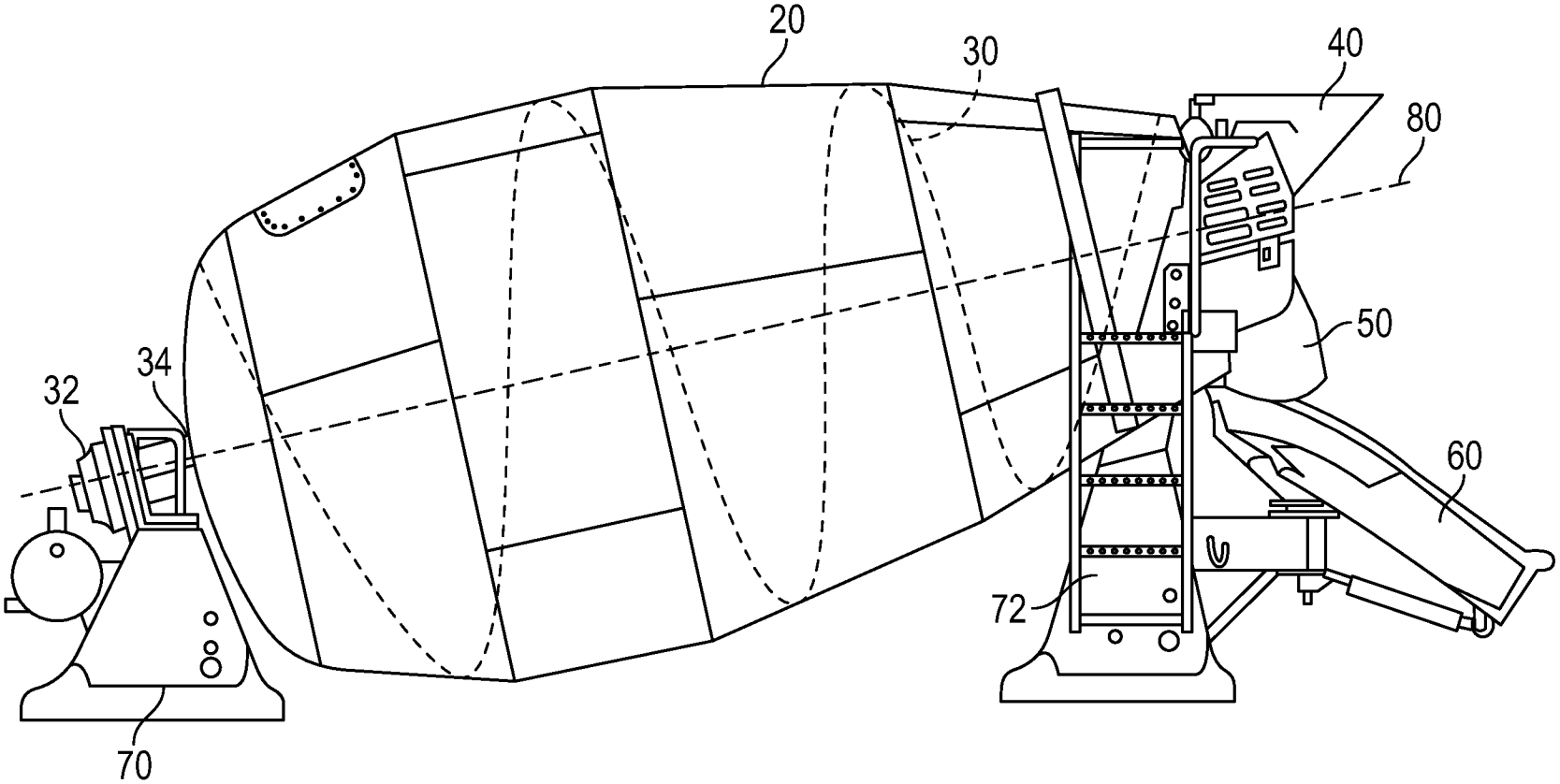
FIG. 3 is a schematic diagram of a mixing drum for a concrete mixing truck including a charge hopper, according to an exemplary embodiment.

FIG. 3 illustrates a mixing drum assembly including the mixing drum 20, the mixing element 30, the drum driver 32, the charge hopper 40, the discharge hopper 50, and the chute 60 isolated from the concrete mixing truck 10. The mixing drum 20 may be coupled to supports (e.g., pedestals, etc.), shown as pedestal 70 and pedestal 72. The pedestal 70 and the pedestal 72 may be coupled to the frame 12 of the concrete mixing truck 10. The pedestal 70 and the pedestal 72 may function to cooperatively couple (e.g., attach, secure, etc.) the mixing drum 20 to the frame 12 and facilitate rotation of the mixing drum 20 relative to the frame 12. In an alternative embodiment, such as is shown in FIG. 3, the mixing drum 20 is configured as a stand-alone mixing drum that is not coupled (e.g., fixed, attached, etc.) to a vehicle. In such an embodiment, the mixing drum 20 may be mounted to a stand-alone frame. The stand-alone frame may be a chassis including wheels that assist with the positioning of the stand-alone mixing drum on a worksite. Such a stand-alone mixing drum may also be detachably coupled to and/or capable of being loaded onto a vehicle such that the stand-alone mixing drum may be transported by the vehicle.

As shown in FIG. 1, the mixing drum 20 defines a central, longitudinal axis 80. According to an exemplary embodiment, the mixing drum 20 is selectively rotated about the longitudinal axis 80 (e.g., by the drum driver 32). The longitudinal axis 80 may be angled relative to the frame (e.g., the frame 12 of the concrete mixing truck 10) such that the longitudinal axis 80 intersects with the frame. For example, the longitudinal axis 80 may be elevated from the frame at an angle in the range of five degrees to twenty degrees. In other applications, the longitudinal axis 80 may be elevated by less than five degrees (e.g., four degrees, three degrees, etc.) or greater than twenty degrees (e.g., twenty-five degrees, thirty degrees, etc.). In an alternative embodiment, the concrete mixing truck 10 includes an actuator positioned to facilitate selectively adjusting the longitudinal axis 80 to a desired or target angle (e.g., manually in response to an operator input/command, automatically according to a control scheme, etc.).

Charge Hopper

Figure 4:
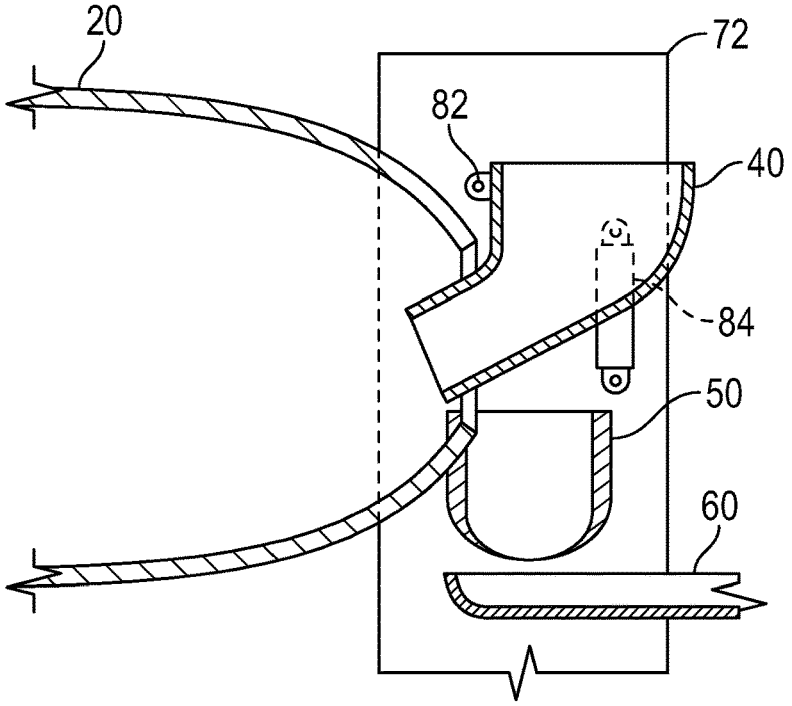
FIGS. 4 and 5 are schematic section views of the mixing drum and charge hopper of FIG. 3.
Figure 5:
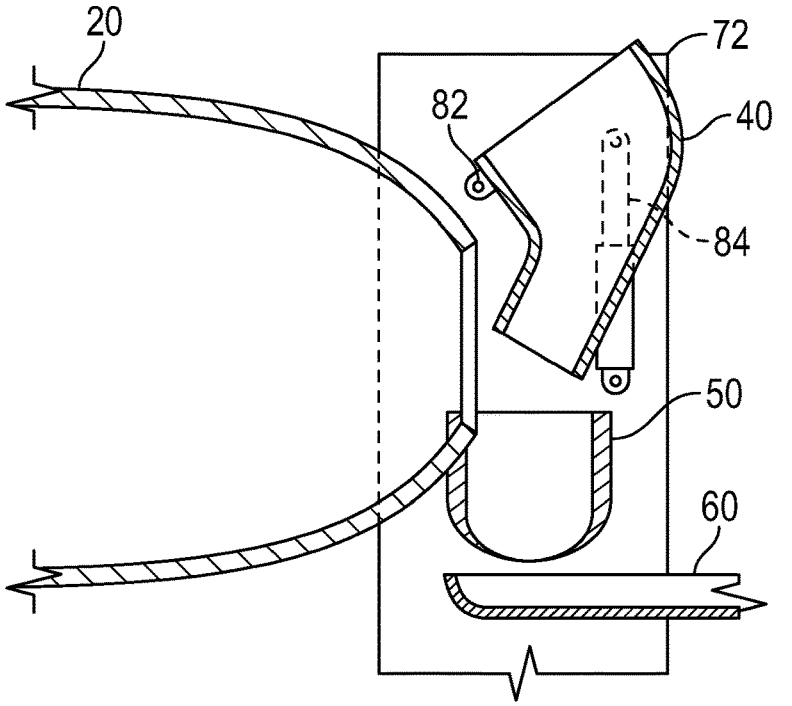

As shown in FIGS. 4 and 5, the charge hopper 40 is pivotally coupled to the pedestal 72, which is in turn coupled to the frame 12 (i.e., the charge hopper 40 is directly pivotally coupled to the pedestal 72 and indirectly pivotally coupled to the frame 12). In other embodiments, the charge hopper 40 is otherwise coupled to the frame 12. The charge hopper 40 is configured to rotate relative to the frame 12 about a lateral axis 82. An actuator (e.g., an electric motor, a hydraulic cylinder, a pneumatic cylinder, etc.), shown as linear actuator 84, is coupled to the pedestal 72 and the charge hopper 40. The linear actuator 84 is configured to selectively reposition the charge hopper 40 between a loading position, shown in FIG. 4, and a dispensing position, shown in FIG. 5. In the loading position, the charge hopper 40 extends into the mixing drum 20 such that material loaded into the charge hopper 40 is directed into the mixing drum 20. In the dispensing position, the charge hopper 40 is rotated away from the mixing drum 20 such that material can be expelled from the mixing drum 20 into the discharge hopper 50 without contacting the charge hopper 40. In other embodiments, only a portion of the charge hopper 40 is moved out of a path of the discharged material. In some such embodiments, a portion of the charge hopper 40 may be fixed relative to the frame 12.

Figure 6:
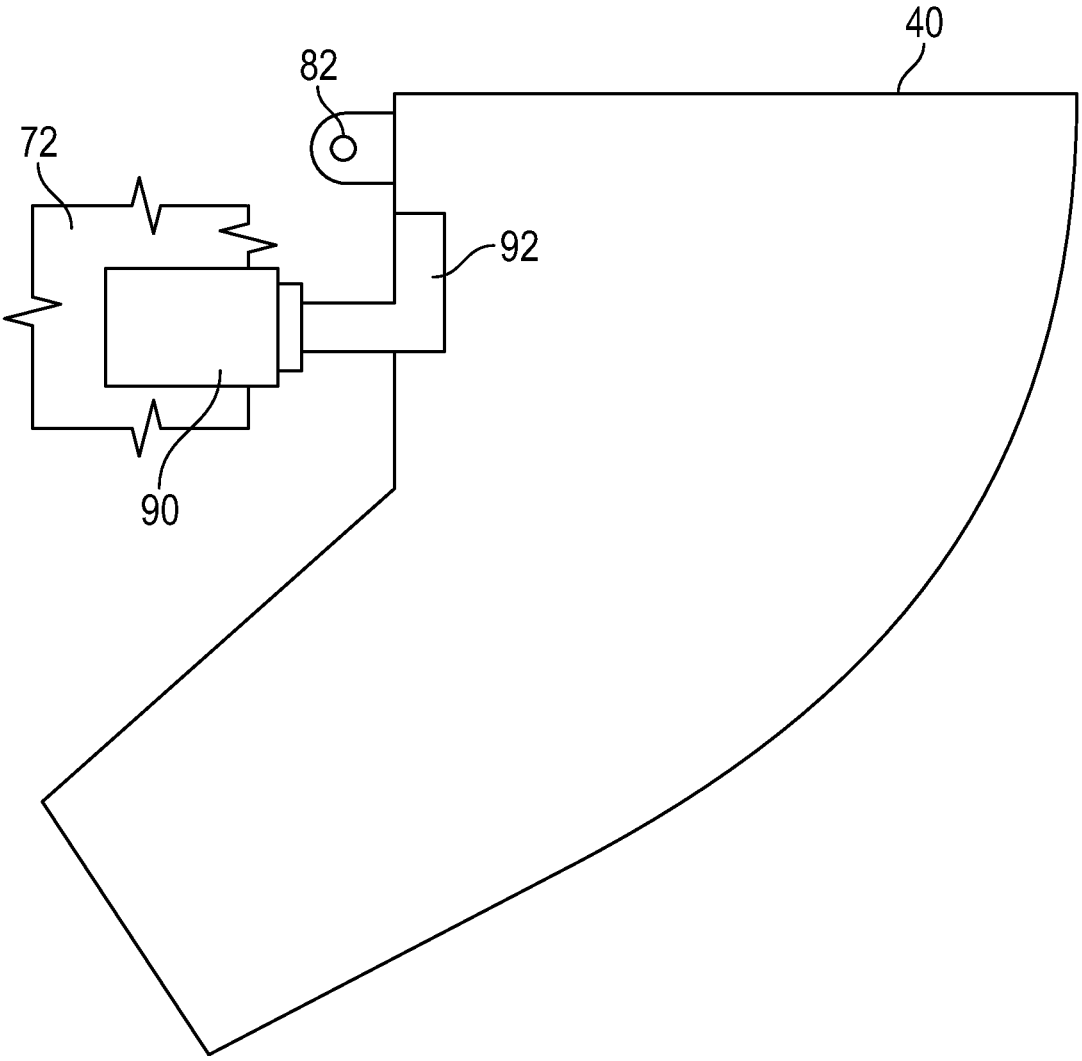
FIG. 6 is a right side view of the charge hopper of FIG. 3 interacting with a switch.

Referring to FIG. 6, the concrete mixing truck 10 includes a sensor, shown as switch 90, that is configured to provide a signal (e.g., an electronic signal, a voltage, fluid flow, etc.) indicating a position of the charge hopper 40 (e.g., to a controller). As shown, the switch 90 is engaged by a protrusion or projection of the charge hopper, shown as L-shaped bracket 92, when the charge hopper 40 is in the loading position. When the L-shaped bracket 92 engages the switch 90, the switch 90 may indicate (e.g., provide a signal to a controller indicating) that the charge hopper 40 is in the loading position. When the L-shaped bracket 92 is not engaging the switch 90, the switch 90 may indicate (e.g., provide a signal to a controller indicating) that the charge hopper 40 is in another position (i.e., not in the loading position). The switch 90 may be coupled to the pedestal 72. The L-shaped bracket 92 may be fixedly coupled to a body of the charge hopper 40. Accordingly, the output of the switch 90 may vary based on a distance between the L-shaped bracket 92 and the switch 90.

Figure 7:
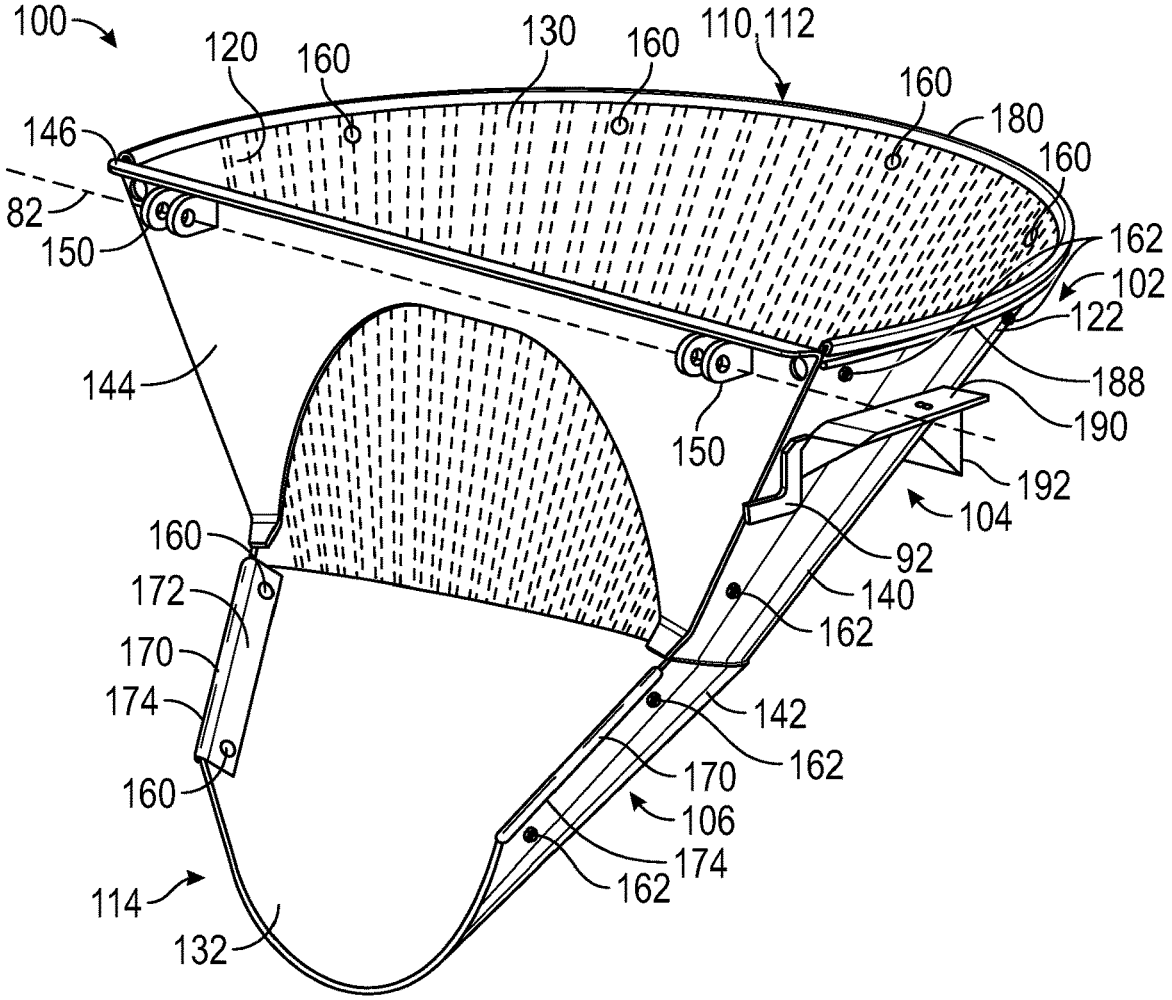
FIG. 7 is a perspective view of the charge hopper of FIG. 3, according to an exemplary embodiment.

Referring to FIG. 7, an embodiment of a charge hopper is shown as hopper 100. The hopper 100 includes a main body, shown as body 102. The body 102 includes a first portion or section (e.g., an inlet portion, a funnel portion, an entry portion, an acceptance portion, etc.), shown as entry portion 104, and a second portion or section (e.g., an outlet portion, a funnel portion, a straight portion, a discharge portion, etc.), shown as discharge portion 106. As shown, the entry portion 104 is fixedly coupled to the discharge portion 106. In other embodiments, the discharge portion 106 is movably (e.g., pivotally) coupled to the entry portion 104.

A flow path for material, shown as passage 110, is defined by the body 102. The passage 110 includes an inlet 112 defined by the entry portion 104 and an outlet 114 defined by the discharge portion 106. As shown, the passage 110 is completely enclosed by the body 102 at the inlet 112 and partially enclosed (e.g., along the bottom and left and right sides) by the body 102 at the outlet 114. The body 102 and the passage 110 are generally funnel-shaped (i.e., a cross-sectional area of the passage 110 and/or a cross-sectional area of the passage 110 enclosed by the body 102 generally decreases as the passage 110 extends from the inlet 112 to the outlet 114). This facilitates providing a wide area for catching material at the inlet 112 and generally concentrating the flow of material to a small area at the outlet 114 (e.g., to facilitate directing the material into an opening of the mixing drum 20).

The body 102 includes an inner section, layer, or assembly (e.g., a material contact layer), shown as liner 120, and an outer section, hopper frame, layer, or assembly (e.g., a structural layer), shown as frame 122. The liner 120 extends inward of (i.e., closer to the passage 110 than) the frame 122. The liner 120 is configured to contact and direct the material as the material flows through the hopper 100. In some embodiments, the liner 120 is continuous along the length of the passage 110 to prevent material deviating from the path defined by the passage 110. The liner 120 may define part or all of the passage 110. The frame 122 is coupled to the liner 120 and configured to support the liner 120. The frame 122 may also couple the liner 120 the frame 12 and/or the linear actuator 84.

The liner 120 includes a first piece or section, shown as entry portion liner 130, that is positioned within the entry portion 104 of the body 102. In some embodiments, the entry portion liner 130 is one continuous sheet of material. The liner 120 further includes a second piece or section, shown as discharge portion liner 132, that is positioned within the discharge portion 106 of the body 102. In some embodiments, the entry portion liner 130 is one continuous sheet of material. As shown, the entry portion liner 130 overlaps the discharge portion liner 132 to ensure that the liner 120 is continuous along the length of the passage 110. In some embodiments, the entry portion liner 130 and/or the discharge portion liner 132 each have a substantially C-shaped cross section that extends along the bottom, left, and right sides of the passage 110 to direct the material.

The frame 122 includes a first piece or section, shown as entry portion frame 140, and a second piece or section, shown as discharge portion frame 142. The entry portion frame 140 and the discharge portion frame 142 may be fixedly coupled (e.g., welded, adhered, etc.) to one another. As shown, the entry portion frame 140 and the discharge portion frame 142 are positioned in the entry portion 104 and the discharge portion 106 of the body 102, respectively. Specifically, as shown, the entry portion frame 140 and the discharge portion frame 142 extend along an outer surface of the entry portion liner 130 and the discharge portion liner 132. The entry portion frame 140 and the discharge portion frame 142 each have a substantially C-shaped cross section.

The frame 122 further includes a front plate 144 that extends across a gap defined by the entry portion frame 140. The front plate 144 may be fixedly coupled to the entry portion frame 140. The front plate 144 is positioned within the entry portion 104. As shown, the inlet 112 is surrounded by the entry portion frame 140 and the front plate 144. The front plate 144 includes a flange 146 extending substantially perpendicular to the passage 110 at the inlet 112 and extends away from the passage 110.

A pair of couplers, protrusions, or bosses, shown as devises 150, are fixedly coupled to the front plate 144. The devises 150 each extend away from the passage 110 at a front side of the hopper 100. The devises each include a pair of plates, and each plate defines an aperture. The apertures of the devises 150 are aligned with one another along the lateral axis 82. One or more rods, bolts, or pins may be inserted through the apertures of the devises 150 to pivotally couple the hopper 100 to the frame 12.

In some embodiments, the liner 120 and the frame 122 are made from (e.g., include, are made entirely from, are made primarily from) different materials. The use of different materials may facilitate the liner 120 having different properties than the frame 122 (e.g., resistance to abrasion versus resistance to deformation, etc.).

In some embodiments, the liner 120 is made from a non-metallic material. In some embodiments, the non-metallic material is a polymeric material. In some embodiments, the non-metallic material is a composite material. In some embodiments, the composite material includes woven fibers (e.g., E-glass, carbon filaments, etc.) embedded in a binding agent (e.g., urethane, epoxy, etc.). In some embodiments, the liner 120 includes multiple layers of material (e.g., a first material with a coating, etc.). In some embodiments, some of the layers are made using different materials (e.g., composites with different types of fibers) and/or are covered in different coatings. By way of example, an inner layer may be made from a material or coated in a material that is resistant to abrasion. By way of another example, the inner layer may be made from a material or coated in a material that is a certain color (e.g., paint) or that is resistant to damage from sunlight.

In some embodiments, the frame 122 is made from a metal (e.g., steel, aluminum, titanium, etc.). The material of the frame 122 may be less resistant to abrasion than the material of the liner 120. The material of the frame 122 may be capable of receiving a greater loading (e.g., a compressive loading, a tensile loading, a bending loading, etc.) than the material of the liner without deforming or breaking. The material of the frame 122 may facilitate welding. By way of example, the entry portion frame 140, the discharge portion frame 142, the front plate 144, and the devises 150 may be formed as a weldment.

Figure 8:
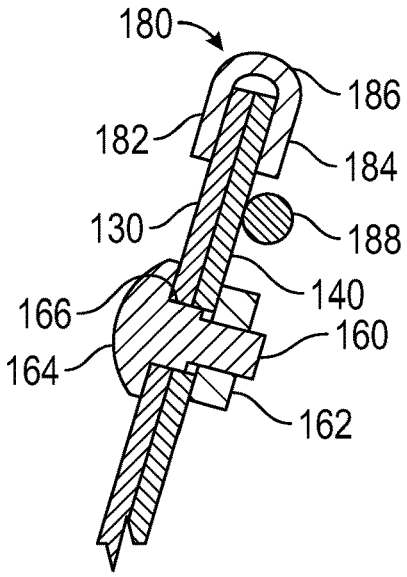
FIG. 8 is a section view of the charge hopper of FIG. 7.

Referring to FIGS. 7 and 8, the entry portion liner 130 is coupled to the entry portion frame 140 by a series of fasteners, shown as bolts 160 and nuts 162. Specifically, a first series of bolts 160 are arranged near the inlet 112, and a second series of bolts 160 are spaced from the first series of bolts 160 along the passage 110. The bolts 160 each extend through corresponding apertures defined by the entry portion liner 130 and the entry portion frame 140 and engage one of the nuts 162 to couple the entry portion liner 130 to the entry portion frame 140. A head 164 of each bolt 160 is positioned along an inner surface of the entry portion liner 130, and the nut 162 is positioned along an outer surface of the entry portion frame 140. A threaded portion of the bolt 160 engages the nut 162 to couple the nut 162 to the bolt 160. In some embodiments, the head 164 is rounded or thin and flat to minimize the amount of resistance to the flow of material caused by the bolt 160. In some embodiments, the bolt 160 is a carriage bolt. In some such embodiments, the bolt 160 includes a neck, non-circular protrusion, or non-circular portion, shown as square protrusion 166, that engages a correspondingly shaped aperture (e.g., a square aperture) in the liner 120 and/or frame 122. Interference between the square protrusion 166 and the aperture(s) limits (e.g., prevents) rotation of the bolt 160, eliminating the need for a wrench to hold the bolt 160 during installation or removal. The use of a carriage bolt also prevents placing a wrench interface (e.g., an Allen key recess, a hexagonal head, etc.) in contact with the flow of material, which could otherwise wear the wrench interface, preventing removal.

A similar set of bolts 160 and nuts 162 couple the discharge portion liner 132 to the discharge portion frame 142. However, these bolts 160 each also extend through a guard plate 170. The hopper 100 includes a pair of guard plates 170, each positioned on opposite sides of the passage 110. The guard plates 170 each include a main plate 172 extending along an inner surface of the discharge portion liner 132 and a flange 174 extending substantially perpendicular to the main plate 172, outward from the passage 110. The flanges 174 may extend over both the liner 120 and the frame 122 to prevent material entering between the liner 120 and the frame 122. The main plates 172 each define a pair of apertures configured to receive the bolts 160. The apertures may be correspondingly shaped to the square protrusions 166 to limit (e.g., prevent) rotation of the bolts 160.

The bolts 160 and the nuts 162 may removably couple the liner 120 to the frame 122 to facilitate selective removal and replacement of the liner 120 when the liner 120 becomes worn from use (e.g., to maintain the hopper 100). In other embodiments, a different type of fastener is used (e.g., rivets, etc.). In other embodiments, the bolts 160 and the nuts 162 are omitted, and the liner 120 is otherwise coupled to the frame 122 (e.g., by an adhesive).

Referring again to FIGS. 7 and 8, the hopper 100 further includes a guard or cover, shown as top guard 180. The top guard 180 extends across the top surfaces of the entry portion liner 130 and the entry portion frame 140 at the inlet 112. The top guard 180 includes a first lip, flange, or plate, shown as inner flange 182, as second lip, flange, or plate, shown as outer flange 184, and a connecting portion or flange, shown as connecting flange 186. The inner flange 182 extends along an inner surface of the entry portion liner 130. The outer flange 184 extends along an outer surface of the entry portion frame 140. The connecting flange 186 extends between and is coupled to both the inner flange 182 and the outer flange 184. Together, the inner flange 182, the outer flange 184, and the connecting flange 186 form a C shape. The top guard 180 extends over both the liner 120 and the frame 122 (e.g., at or adjacent the inlet 112) to prevent material entering between the liner 120 and the frame 122. Additionally, the top guard 180 prevents contact between the flow of material and the frame 122, reducing wear on the frame 122.

In some embodiments, the top guard 180 is coupled to the liner 120 and the frame 122 by a friction fit. By way of example, the connecting flange 186 may bias the inner flange 182 and the outer flange 184 toward one another such that friction between the top guard 180 and the liner 120 and/or the frame 122 limits movement of the top guard 180. In other embodiments, a protrusion is coupled to the inner flange 182 and/or the outer flange 184 and the protrusion engages a corresponding protrusion or recess formed by the liner 120 and/or the frame 122 to limit movement of the top guard 180. In other embodiments, the top guard 180 is otherwise held in place (e.g., through use of an adhesive).

A rib, shown as rod 188, extends circumferentially along an outer surface of the entry portion frame 140. As shown, the rod 188 has a circular cross section. The rod 188 may strengthen the frame 122 near the inlet 112 (e.g., to reduce deformation caused by an impact). In other embodiments, the rod 188 has a rectangular cross section and/or is a flange.

Referring to FIG. 8, an L-shaped bracket 92 is coupled to the entry portion frame 140. A bracket, shown as actuator mounting bracket 190, is coupled to the entry portion frame 140. The actuator mounting bracket 190 extends circumferentially along an outer surface of the entry portion frame 140. The actuator mounting bracket 190 may define one or more apertures to couple the hopper 100 to the linear actuator 84. Another actuator mounting bracket 190 may be symmetrically placed on an opposite side of the body 102. Another bracket, shown as back bracket 192, is coupled to a rear side of the entry portion frame 140. The back bracket 192 may define one or more apertures configured to receive one or more lights or signals (e.g., brake lights, turn signals, etc.).

Figure 9:
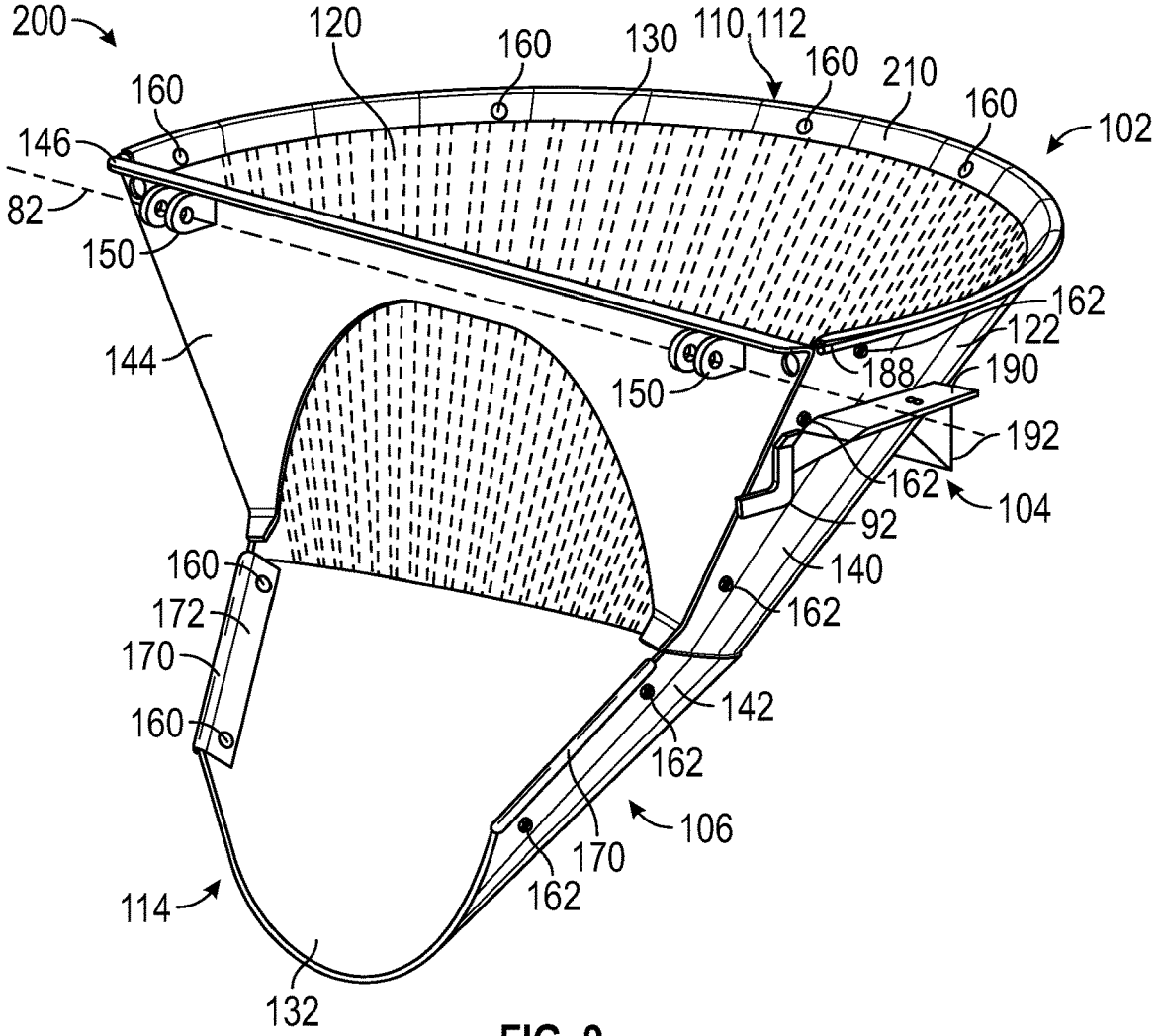
FIG. 9 is a perspective view of the charge hopper of FIG. 3, according to another exemplary embodiment.
Figure 10:
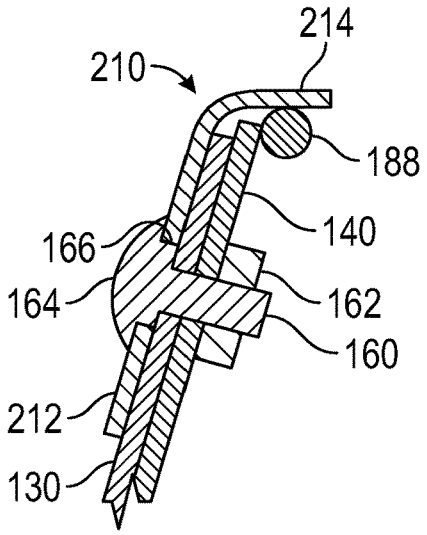
FIG. 10 is a section view of the charge hopper of FIG. 9.

Referring to FIGS. 9 and 10, an alternative embodiment of a charge hopper is shown as hopper 200. The hopper 200 may be substantially similar to the hopper 100 except as otherwise stated herein. The top guard 180 is omitted from the hopper 200. The hopper 200 includes a top guard 210 extending along the edge of the inlet 112. In some embodiments, the hopper 200 includes multiple top guards 210 positioned along the edge of the inlet (e.g., positioned end to end). The top guard 210 includes a main plate 212 extending along an inner surface of the entry portion liner 130 and a flange 214 extending substantially perpendicular to the main plate 212, outward from the passage 110. The top guard 210 may be formed in (e.g., cut into) multiple sections along the length of the top guard 210 to facilitate bending of the top guard 210 to match the curvature of the inlet 112. The flange 214 may extend at least partially across the top surfaces of both the liner 120 and the frame 122 to prevent material entering between the liner 120 and the frame 122. Additionally, the top guard 210 prevents contact between the flow of material and the frame 122, reducing wear on the frame 122.

The main plate 212 defines a series of apertures configured to receive the bolts 160. The apertures may be correspondingly shaped to the square protrusions 166 to prevent rotation of the bolts 160. As shown, the rod 188 is positioned near a top edge of the entry portion frame 140. The flange 214 may be positioned adjacent and/or engage the rod 188.

Figure 11:
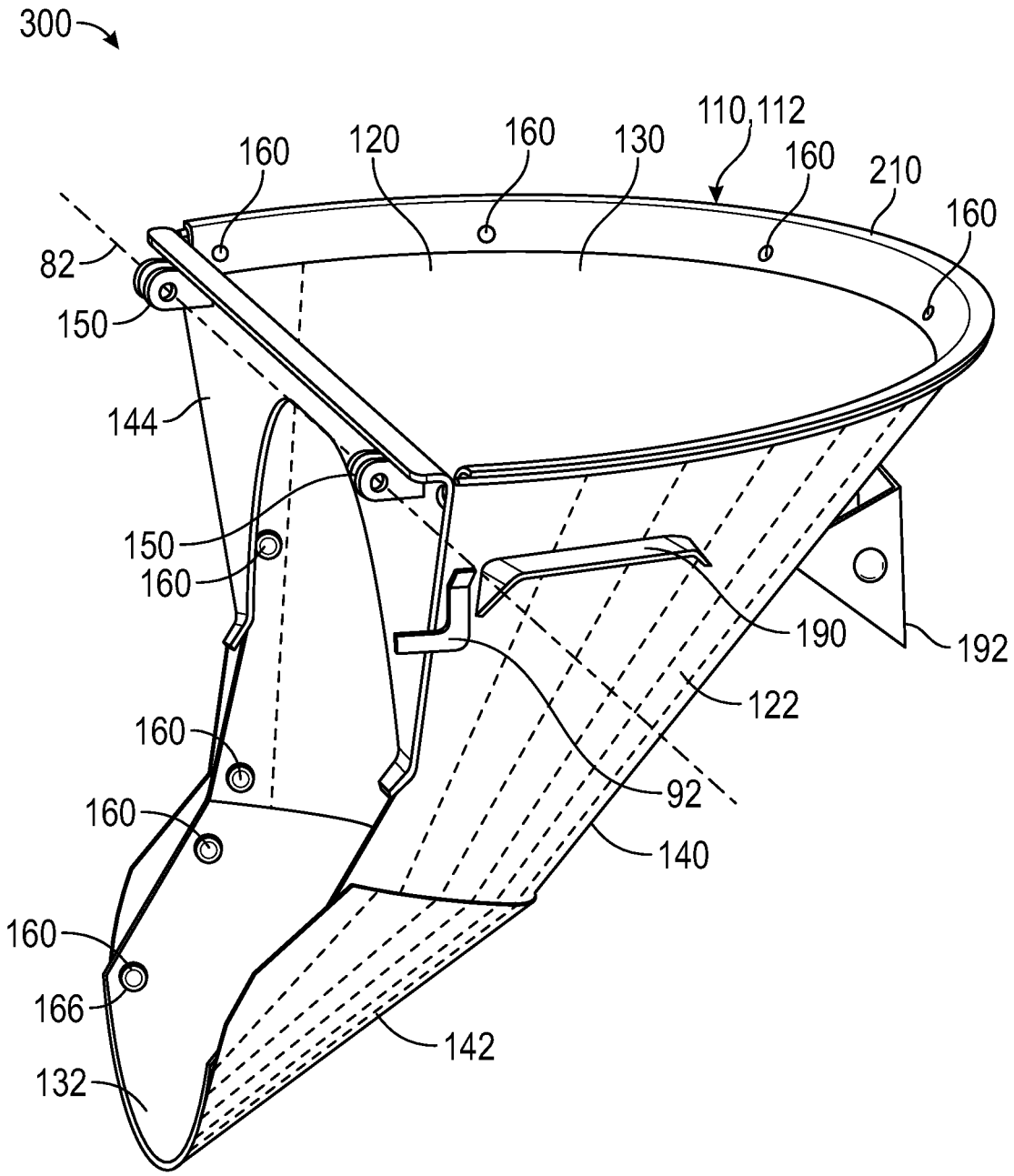
FIG. 11 is a perspective view of the charge hopper of FIG. 3, according to another exemplary embodiment.

Referring to FIG. 11, an alternative embodiment of a charge hopper is shown as hopper 300. The hopper 300 may be substantially similar to the hopper 200 except as otherwise stated herein. As shown in FIG. 11, the guard plates 170 are removed, and the heads 164 of the bolts 160 directly engage an inner surface of the discharge portion liner 132.

Figure 12:
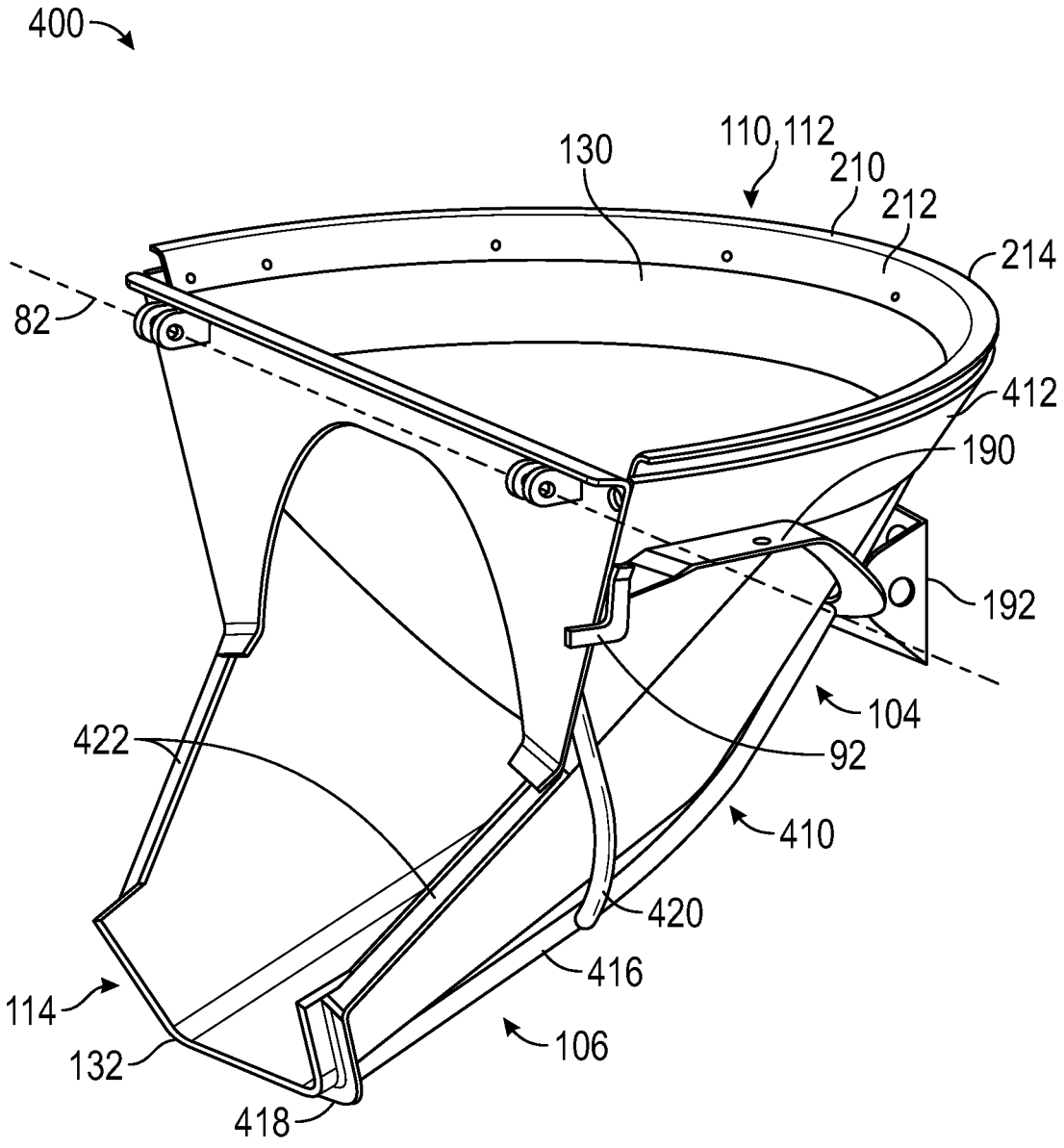
FIG. 12 is a perspective view of the charge hopper of FIG. 3, according to another exemplary embodiment.
Figure 13:
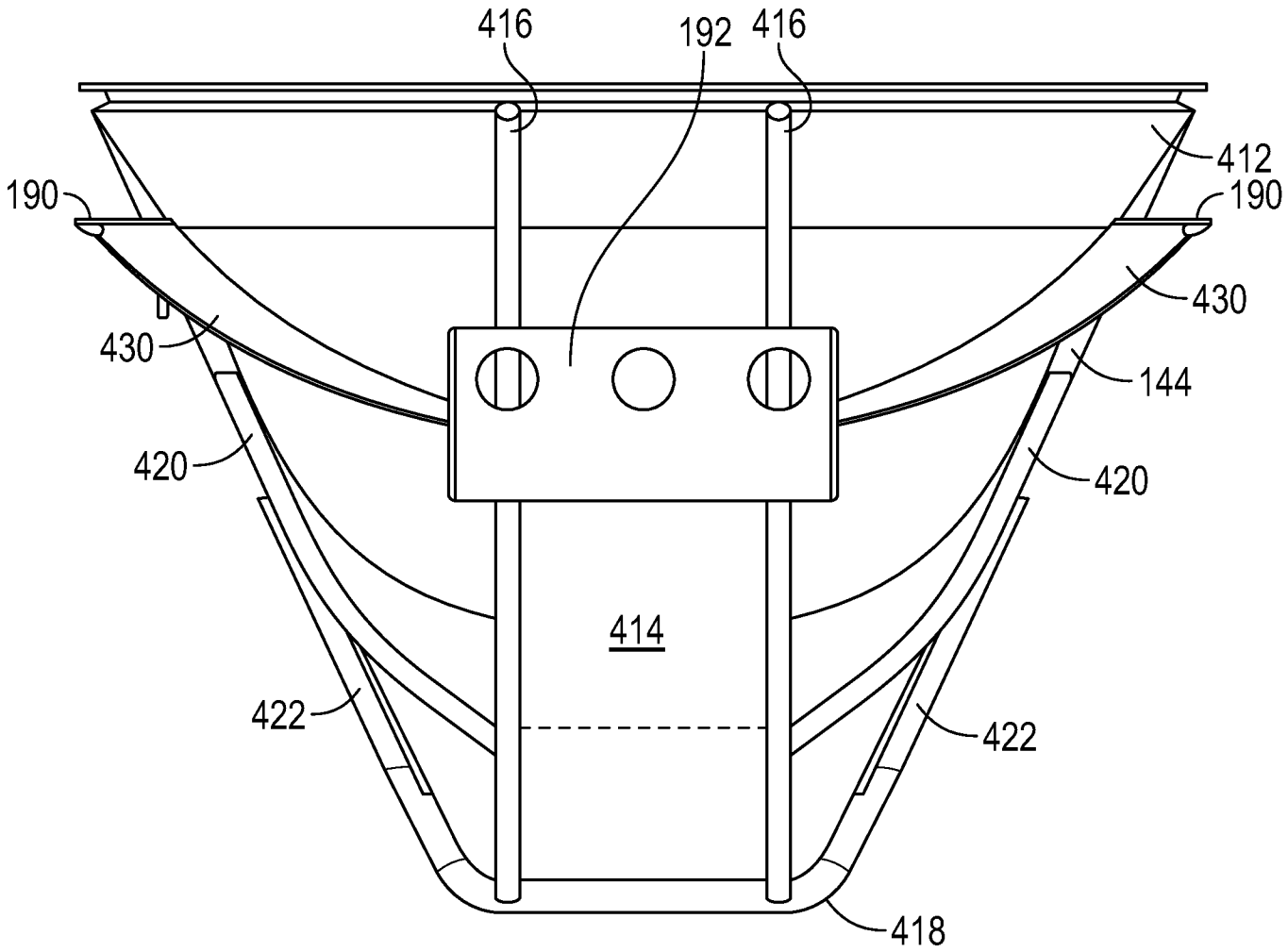
FIG. 13 is a rear view of the charge hopper of FIG. 12.

Referring to FIGS. 12 and 13, an alternative embodiment of a charge hopper is shown as hopper 400. In this embodiment, the frame 122 is replaced with a frame 410. The frame 410 includes a series of frame members fixedly coupled (e.g., welded, adhered, etc.) to one another. The frame 410 includes a first frame member, shown as circumferential plate 412, that extends circumferentially around the liner 120 in the entry portion 104. A second frame member, shown as longitudinal plate 414, extends longitudinally along the length of the passage 110 and along the bottom side of the hopper 400 toward the outlet 114 from the circumferential plate 412. The circumferential plate 412 and the longitudinal plate 414 may be integrally formed as a single piece of material. A pair of frame members, shown as longitudinal tubes 416, are coupled to a bottom surface of the longitudinal plate 414 and extend along the laterally-outermost edges of the longitudinal plate 414 from the inlet 112 to the outlet 114. A frame member, shown as U-shaped angle 418 extends along a circumference of the outlet 114. The U-shaped angle 418 may have an L-shaped cross section. A pair of frame members, shown as circumferential tubes 420, extend circumferentially from each longitudinal tube 416 to the front plate 144 and the circumferential plate 412. A pair of frame members, shown as longitudinal tubes 422, extend longitudinally from the front plate 144 and the circumferential plate to the U-shaped angle 418. A pair of frame members, shown as circumferential ribs 430, extend between the actuator mounting brackets 190 and the back bracket 192.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the concrete mixing truck as shown in the various exemplary embodiments is illustrative only. Additionally, any element disclosed in one embodiment may be incorporated or utilized with any other embodiment disclosed herein. For example, the top guard 180 of the exemplary embodiment shown in at least FIG. 7 may be incorporated in the hopper 400 of the exemplary embodiment shown in at least FIG. 12. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A mixing drum assembly, comprising:
- a frame;
- a mixing drum rotatably coupled to the frame; and
- a charge hopper coupled to the frame and positioned to direct material into the mixing drum, the charge hopper comprising:
  - a hopper frame;
  - a liner extending along an inner surface of the hopper frame and at least partially defining a passage extending between an inlet and an outlet; and
  - a top guard removably coupled to the liner and positioned adjacent the inlet, the top guard including a flange that at least partially covers both a top surface of the liner and a top surface of the hopper frame,
- wherein the hopper frame includes a first material and the liner includes a second material different from the first material, and wherein the liner is removably coupled to the hopper frame.

2. The mixing drum assembly of claim 1, further comprising a fastener extending through the liner and the hopper frame to removably couple the liner to the hopper frame.

3. The mixing drum assembly of claim 2, wherein the fastener includes a head positioned adjacent the passage and a neck that is shaped to engage at least one of the hopper frame or the liner to limit rotation of the fastener relative to the hopper frame.

4. The mixing drum assembly of claim 1, wherein the top guard extends along an inner surface of the liner, further comprising a fastener extending through the top guard, the liner, and the hopper frame to removably couple the top guard and the liner to the hopper frame.

5. The mixing drum assembly of claim 4, wherein the fastener includes a neck extending through an aperture defined by the top guard, and wherein the neck and the aperture are shaped such that the neck engages the top guard to limit rotation of the fastener relative to the hopper frame.

6. The mixing drum assembly of claim 5, wherein the fastener includes a head extending along an inner surface of the top guard, further comprising a nut coupled to the fastener, wherein the top guard, the liner, and the hopper frame extend between the head and the nut.

7. The mixing drum assembly of claim 1, further comprising:

a bracket fixedly coupled to the hopper frame, wherein the charge hopper is movably coupled to the frame; and a sensor coupled to the frame and configured to indicate a position of the charge hopper based on a distance between the sensor and the bracket.

8. The mixing drum assembly of claim 7, wherein the hopper frame includes a boss pivotally coupling the charge hopper to the frame, wherein the sensor is configured to indicate that the charge hopper is in a first position when the bracket engages the sensor, and wherein the sensor is configured to indicate that the charge hopper is in a second position when the bracket is not engaging the sensor.

9. The mixing drum assembly of claim 1, wherein the first material is a metal, and wherein the second material is a composite including at least two different materials.

10. The mixing drum assembly of claim 9, wherein the at least two different materials of the composite include woven fibers and a binder.

11. The mixing drum assembly of claim 1, wherein the mixing drum assembly is a concrete mixer vehicle, further comprising:

a cab coupled to the frame;

a plurality of tractive elements coupled to the frame; and a primary driver configured to drive at least one of the tractive elements to propel the concrete mixer vehicle.

12. The mixing drum assembly of claim 1, wherein the liner extends between the hopper frame and the top guard.

13. A charge hopper for a concrete mixer, the charge hopper comprising:

a hopper frame configured to be coupled to a frame of the concrete mixer;

a liner extending along an inner surface of the hopper frame and defining a passage extending between an inlet and an outlet;

a top guard positioned adjacent the inlet and extending along an inner surface of the liner such that the liner extends between the hopper frame and the top guard; and a plurality of fasteners extending through the hopper frame and the liner to couple the liner to the hopper frame, wherein at least one of the fasteners extends through the top guard and the liner to removably couple the top guard and the liner to the hopper frame.

14. The charge hopper of claim 13, wherein the top guard includes a flange extending away from the passage and over the hopper frame.

15. The mixing drum assembly of claim 13, wherein the liner is removably coupled to the top guard.

16. A method of maintaining a charge hopper of a concrete mixer, comprising:

providing the charge hopper, the charge hopper including a hopper frame, a first liner coupled to the hopper frame, and a top guard coupled to the hopper frame and the first liner such that the first liner extends between the hopper frame and the top guard, wherein the first liner at least partially defines a passage through the charge hopper;

removing the first liner from the hopper frame and the top guard, wherein removing the first liner from the hopper frame comprises removing a first fastener that couples the first liner to the hopper frame;

coupling a second liner to the hopper frame using a second fastener, the second liner at least partially defining the passage through the charge hopper; and coupling the top guard to the hopper frame and the second liner using the second fastener such that the top guard extends along an inner surface of the second liner and over the hopper frame.

17. The method of claim 16, wherein the hopper frame is made from a metal, and wherein the second liner is made from a composite including at least two different materials.

* * * * *